US008303340B2

(12) United States Patent
Seiler

(10) Patent No.: US 8,303,340 B2
(45) Date of Patent: Nov. 6, 2012

(54) FLUID RESISTANT CONNECTOR AND SYSTEM

(75) Inventor: Michael Kevin Seiler, Los Angeles, CA (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 12/816,471

(22) Filed: Jun. 16, 2010

(65) Prior Publication Data

US 2010/0323557 A1 Dec. 23, 2010

Related U.S. Application Data

(60) Provisional application No. 61/218,195, filed on Jun. 18, 2009.

(51) Int. Cl.
*H01R 13/40* (2006.01)

(52) U.S. Cl. ..... 439/589; 439/271

(58) Field of Classification Search ..... 439/271, 439/587–589

See application file for complete search history.

(56) References Cited

U.S. PATENT DOCUMENTS

| | | | | |
|---|---|---|---|---|
| 3,616,415 | A | 10/1971 | Watson et al. | |
| 3,792,415 | A * | 2/1974 | Fuller | 439/588 |
| 4,625,645 | A | 12/1986 | Williams | |
| 4,727,843 | A | 3/1988 | Petersen et al. | |
| 4,728,296 | A | 3/1988 | Stamm | |
| 4,895,533 | A * | 1/1990 | Yagi et al. | 439/587 |
| 5,017,160 | A | 5/1991 | Garcia | |
| 5,113,101 | A | 5/1992 | Liu et al. | |
| 5,205,568 | A * | 4/1993 | Stoll et al. | 277/615 |
| 5,240,433 | A * | 8/1993 | Kato | 439/587 |
| 5,395,266 | A * | 3/1995 | Abe et al. | 439/587 |
| 5,511,990 | A | 4/1996 | Klemen | |
| 5,527,188 | A * | 6/1996 | Ohtaka et al. | 439/587 |
| 5,540,450 | A * | 7/1996 | Hayashi et al. | 277/607 |
| 5,567,174 | A * | 10/1996 | Ericson et al. | 439/462 |
| 5,890,927 | A * | 4/1999 | Yashima | 439/587 |
| 6,152,745 | A | 11/2000 | Matsumoto et al. | |
| 6,323,433 | B1 * | 11/2001 | Mahaney et al. | 174/152 G |
| 6,341,983 | B1 * | 1/2002 | Crawford et al. | 439/587 |
| 6,361,342 | B1 * | 3/2002 | Cox | 439/275 |
| 6,837,744 | B2 | 1/2005 | To et al. | |
| 7,744,411 | B2 | 6/2010 | Casses et al. | |

FOREIGN PATENT DOCUMENTS

| | | |
|---|---|---|
| EP | 1 696 517 | 8/2006 |
| FR | 2 866 485 | 8/2005 |

OTHER PUBLICATIONS

International Search Report for PCT/US2010/038960 mailed Sep. 13, 2010.

* cited by examiner

*Primary Examiner* — Thanh Tam Le
(74) *Attorney, Agent, or Firm* — RatnerPrestia

(57) ABSTRACT

An elastomer moisture resistant connector for at least one conductor disposed at least partially within a jacket of elastomer material. The connector has a first elastomer portion, which has a first end and a second end. The first end of the first elastomer portion is adapted to be compressed against a support. The connector also has a second elastomer portion that is integrally molded with the first elastomer portion and extends from the second end of the first elastomer portion, and is configured to enclose at least a portion of the jacket. The connector also has a third elastomer portion that is integrally molded with the first elastomer portion, protrudes from the second end of the first elastomer portion, and is adapted to be compressed by an enclosure.

19 Claims, 6 Drawing Sheets

FLUID RESISTANT CONNECTOR AND SYSTEM

CROSS REFERENCE TO RELATED APPLICATION

This application claims the benefit of priority to U.S. Provisional Application No. 61/218,195, filed Jun. 18, 2009, the contents of which are incorporated in their entirety by reference herein.

TECHNICAL FIELD

The subject device is a connector for providing a moisture and/or fluid resistant connection for use on any device that is powered by electricity and is subject to liquid hazards during service.

BACKGROUND OF THE INVENTION

Connectors are commonly used for devices, including aircraft devices, powered by electricity to connect one set of electrical conductors such as wires, cables or pins to another set of electrical conductors. Existing connectors commonly used, for example, on aircraft devices powered by electricity are subject to moisture and/or liquid hazards during service. Such devices can fail if their live electrical conductors encounter conductive moisture and/or liquid in the form of water, fuel, hydraulic, de-icing, or other fluids in service. Electrical failure may occur when the live electrical conductor electrically short-circuits, resulting in a loss of electrical power and/or damage to components due to electrical overheating and arcing.

Existing connectors for the sort of applications described above often use a rigid plug made of an epoxy material (or other curing plastic compound) to encapsulate electrical contacts in order to protect the connectors and the electrical contacts from electrically degrading. In an aircraft application, for example, this epoxy plug commonly surrounds a connector solder cup connection, sealing against a metal back-shell on one end, and directly to PTFE (polytetrafluoroethylene; commercial name:)Teflon® coated wires on the other end. This may not be an optimal sealing arrangement because PTFE's inherent non-stick properties may make it difficult to maintain adhesion of epoxy-like materials to the PTFE.

FIG. 1 is a cut away view of a prior art connector. The existing (prior art) design uses a rigid plug 20 made of epoxy material to encapsulate soldered electrical contacts 22 and is intended to protect the contacts from electrically degrading. In the aircraft application, the epoxy plug 20 may surround the connector solder cup connection, sealing against a metal back-shell 25 at one end 20*a* of the plug, and directly to PTFE (polytetrafluoroethylene; commercial name: Teflon®) coated wires 26 on the other end 20*b* of the plug. In an aircraft, the back-shell is a support and provides a sealing surface and boundary for plug 20. It may be difficult to maintain adhesion of the epoxy plug 20 to the PTFE coated wires 26 because of PTFE's inherent non-stick properties. It also may be difficult to maintain adhesion of epoxy to the metal back-shell 25 because of the different respective coefficients of thermal expansion of the plug 20's epoxy and the back-shell 25's metal.

SUMMARY OF THE INVENTION

An exemplary embodiment of the present invention is an elastomer moisture resistant connector for at least one conductor disposed at least partially within a jacket of elastomer material. The exemplary embodiment of the connector has a first elastomer portion. The first elastomer portion has a first end and a second end. The first end of the first elastomer portion is adapted to be compressed against a support. The connector also has a second elastomer portion that may be integrally molded with the first elastomer portion and may extend from the second end of the first elastomer portion. The second elastomer portion may be configured to enclose at least a portion of the jacket. The connector also has a third elastomer portion that may be integrally molded with the first elastomer portion. The third elastomer portion may also protrude from the second end of the first elastomer portion and may be adapted to be compressed by an enclosure .

Another exemplary embodiment of the present invention is an apparatus for providing a moisture resistant connection of at least one conductor within a jacket of elastomer material to at least a second conductor. This exemplary apparatus has a connector and an enclosure that may be configured to compress the connector against a support. The connector has a first elastomer portion, which has a first end and a second end. The connector also has a second elastomer portion that may be integrally molded with the first elastomer portion and may extend from the second end of the first elastomer portion. At least a portion of the jacket may be disposed within the second elastomer portion. The connector also has a third elastomer portion that may be integrally molded with the first elastomer portion and may protrude from the second end of the first elastomer portion.

DETAILED DESCRIPTION OF THE INVENTION

The present connector can be used, for example with a DC10/MD11 aircraft fuel boost pump, but can be used in any environment that might be exposed to moisture or conductive liquids. The fuel pump incorporates an electric motor fed by 400 cycle 3 phase power. A DC10/MD11 aircraft fuel boost pump uses a cartridge style set-up with a motor that is removable from a housing that is mounted semi-permanently in the aircraft fuel tank. The electrical power leadwires run through the fuel tank of the aircraft and terminate in a connector at the housing and mating connector at a removable cartridge.

The present connector can replace the prior art rigid epoxy-like material used in the applications described above with a connector made of an elastomeric compound. An exemplary elastomeric compound may be Viton® (vinylidenfluoride-hexafluoroisopropene-copolymer), but may be any elastomeric compound that would have fluid resistant properties suitable for the fluid in which the connector may be immersed and suitable for the application environment. Elastomers provide deformability which may be lacking in the epoxy-like materials that have been used in the existing connector designs. An elastomer may be able to withstand the effects of temperature fluctuations without delaminating from an adjacent surface. The elastomer may also provide and maintain a sealing interface with an adjacent surface to which it may be coupled. The present connector may provide a moisture resistant electrical connection of at least one electrical conductor that is at least partially encased by jacket of elastomer material to at least a second electrical conductor. Exemplary embodiments of such a connector are shown in the other figures.

Figure 1:
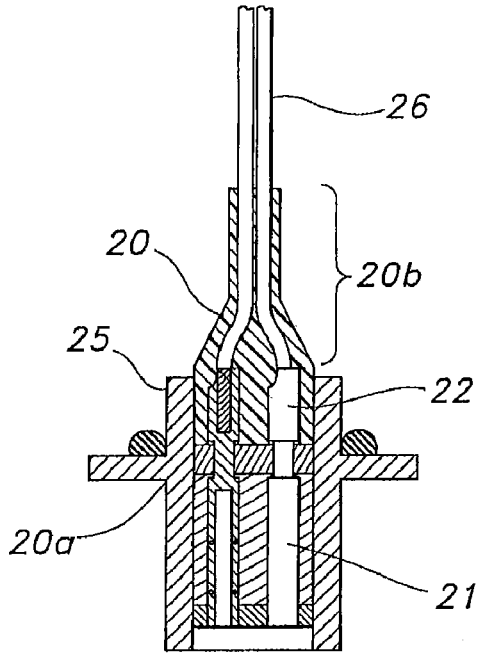
FIG. 1 (PRIOR ART)
FIG. 1 is a cut away view of a prior art connector.
Figure 2:
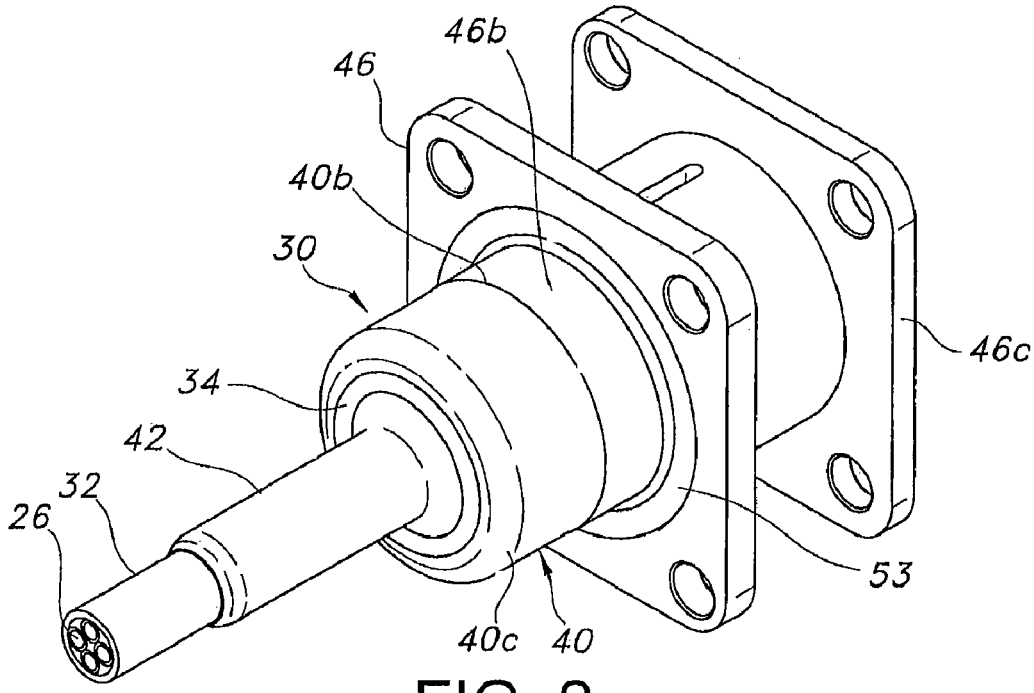
FIG. 2 is a perspective view of a connector in accordance with an exemplary embodiment of the present invention.
Figure 3:
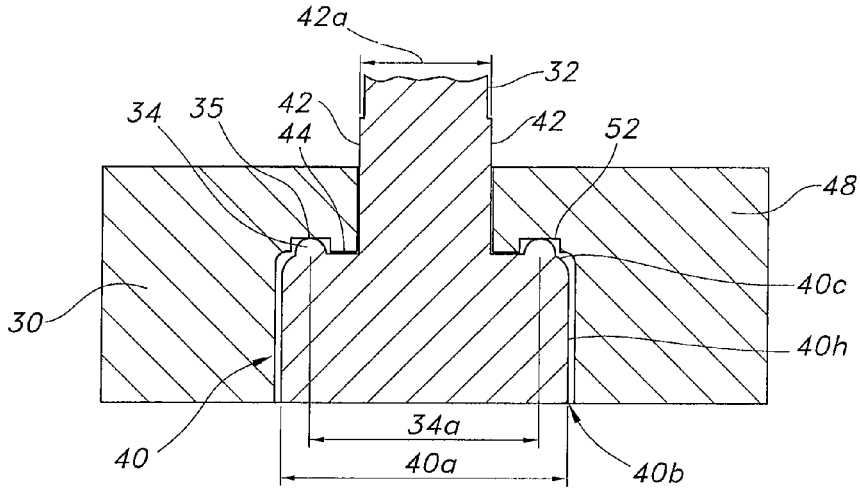
FIG. 3 is a cut-away view of part of the exemplary embodiment of the connector illustrated in FIG. 2.
Figure 4:
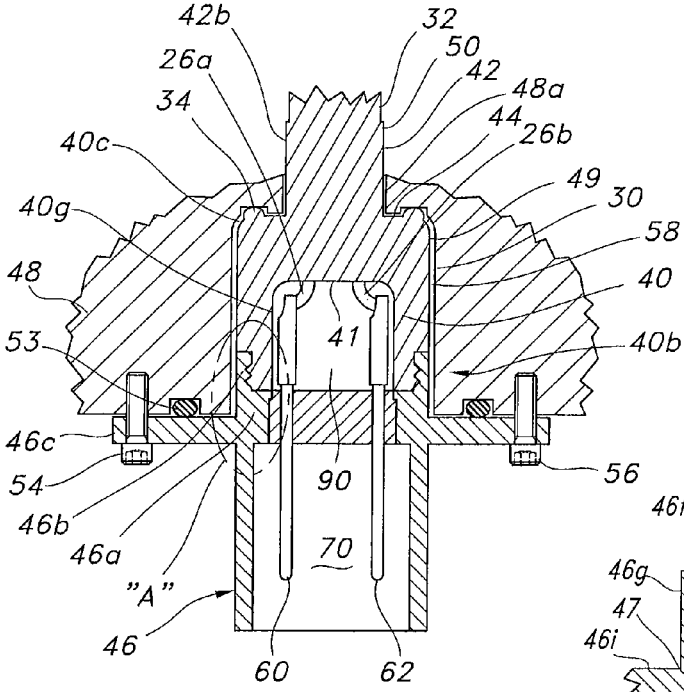
FIG. 4 is a cross-section view of an exemplary apparatus for providing a moisture resistant connection using the exemplary connector illustrated in FIGS. 2 and 3.

FIG. 2 is a perspective view of a connector in accordance with an exemplary embodiment of the present invention. FIG. 3 is a cut-away view of part of the exemplary embodiment of the connector illustrated in FIG. 2. FIG. 4 is a cross-section view of an exemplary apparatus for providing a moisture resistant connection using the exemplary connector illustrated in FIGS. 2 and 3

As shown in FIG. 2, conductors such as electrical wires 26, which in one application may be pump power leadwires, may be encased in an elastomer wire jacket 32. The elastomer wire jacket 32 may be made of Viton® or another elastomer having characteristics that are described above. In alternative uses for the connector, conductors other than electrical wires may be encased in the elastomer jacket 32.

The exemplary connector comprises a plug 30 made of an elastomer material and may be cylindrically shaped. The plug 30 may comprise a one-piece, multi-portion, unit made of an elastomer material. In an alternative embodiment, the plug 30 may comprise more than one piece, one or more of the portions being made of respective separate pieces. In an exemplary embodiment, the plug 30 may be made of the same elastomer material that comprises the elastomer jacket 32, for example, Viton® or elastomers having the characteristics described above. In an alternative embodiment, the plug 30 may be made of an elastomer material that is different from the elastomer material comprising the elastomer jacket 32. If a different elastomer is used for the plug 30, the elastomer for plug 30 should have characteristics that are similar to the characteristics of the elastomer jacket in order to maintain a consistent bond between the jacket 32 and the plug 30.

An exemplary embodiment of plug 30 may have at least three components integrally formed as a single seamless unit. One component may be a cylindrically shaped first elastomer portion 40 having a first diameter 40*a*, illustrated best in FIGS. 2 and 3. The first elastomer portion 40 has an inside surface 41, best seen in FIG. 4, a first end 40*b* and a second end 40*c*. The first end 40*b* of the first elastomer portion 40 may be adapted to be compressed against a support 46 shown, for example, in FIGS. 2 and 4. For example, support 46 may be a plate or a wall configured to provide a sealing surface and a boundary for the first elastomer portion 40. In an exemplary embodiment of the support, where the connector may be used in an aircraft setting, support 46 may be a connector back shell.

Figure 4A:
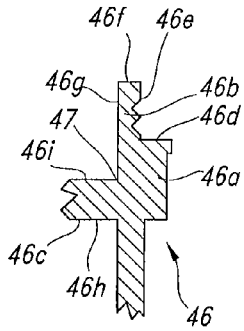
FIG. 4*a* is an exploded view of a segment of an exemplary embodiment of a support for the connector shown in FIG. 4.

FIG. 4*a* is an exploded view of an exemplary segment of the support 46 within "A" in FIG. 4. The support 46 may include a first cylindrically shaped support portion 46*a*, a second cylindrically shaped support portion 46*b* extending perpendicularly from the first support portion 46*a*, and a flange 46*c* extending from the first and second support portions. The second support portion 46*b* may be narrower than the first support portion 46*a* and may extend perpendicularly from the first support portion 46*a*. The first support potion 46*a* may have a first surface 46*d*. The second support portion 46*b* may have a second surface 46*e*, a third surface 46*f*, and a fourth surface 46*g*. Flange 46*c* may extend perpendicularly from both the first support portion 46*a* and the second support portion 46*b* and may have a fifth surface 46*h* and a sixth surface 46*i*.

Figure 4B:
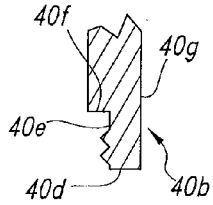
FIG. 4*b* is an exploded view of an exemplary segment of the exemplary connector shown in FIG. 4.

FIG. 4*b* is an exploded view of an exemplary embodiment of the segment of first elastomer portion 40 within "A" in FIG. 4. The first end 40*b* may include a first surface 40*d*, a second surface 40*e*, a third surface 40*f*, and a fourth surface 40*g*. The second surface 40*e* of first end 40*b* may be approximately the same length as the second surface 46*e* of the support 46 and may be substantially perpendicular to the first surface 40*d* of the first end 40*b*. The width of third surface 40*f* of first end 40*b* may be approximately the same width as the third surface 46*f* of the support 46 and may be substantially perpendicular to the second surface 40*e*.

Referring to FIG. 4, for example, surface 40*g* and inside surface 41 of the first elastomer portion 40 form a hollow space 90 which is discussed in more detail below.

A second component of plug 30 may be a tubular shaped second elastomer portion 42 having a second diameter 42*a* seen best in FIG. 3. The second diameter 42*a* may be smaller than the first diameter 40*a*. The second elastomer portion 42 may be integrally molded with the first elastomer portion 40 and may extend from the first elastomer portion 40. In an exemplary embodiment, second elastomer portion 42 may extend longitudinally away from first elastomer portion 40. That is, a longitudinal axis of second elastomer portion 42 may be substantially parallel to a longitudinal axis of first elastomer portion 40 and substantially perpendicular to surface 44 of first elastomer portion 40. In an alternative embodiment, the second elastomer portion 42 may extend longitudinally away from surface 44 of first elastomer portion 40 at an angle other than 90 degrees. In all embodiments, the second elastomer portion 42 may be sufficiently flexible so that, in use, the angular relationship between the second elastomer portion 42 and the first elastomer portion 40 may vary.

Although in use, the length of conductors 26 and the length of elastomer jacket 32 may be quite long and may extend to a source of power (not shown), in an exemplary embodiment, the length of the second elastomer portion 42 may not be as long as the conductors 26 and may not be as long as elastomer jacket 32. As best shown in FIG. 2, at least a portion of the elastomer jacket 32, along with at least a portion of conductors 26, may be encased within the second elastomer portion 42. At least two conductors 26*a* and 26*b* may extend into and through first elastomer portion 40 and through inside surface 41 to a location inside the hollow space 90 of plug 30.

Regardless of the length of the second elastomer portion 42, some or all of the inside surface of second elastomer portion 42 may be bonded or fused to the outside surface of elastomer jacket 32. A purpose of the bonding or fusing of second elastomer portion 42 to the elastomer jacket 32 may be to prevent or resist moisture and/or liquids from contacting any of the conductors 26, from contacting any other conductors to which conductors 26 may be connected, and from otherwise entering into hollow space 90. In an exemplary embodiment, the bonding material may be an elastomer adhesive such as a vulcanizing Viton® material or a cross-linked Viton® material. If a vulcanizing material is used, heat may be applied to the second elastomer portion 42 after the vulcanizing material is applied to the elastomer jacket 32 and/or to the second elastomer portion 42. The bonding or fusing material may be applied to part or all of the interfacing surfaces between the elastomer jacket 32 and the second elastomer portion 42. In alternative embodiments, the bonding or fusing material may be a nitrol compound, an aromatic adhesive, or other thermal or solvent based bonding material.

Figure 5:
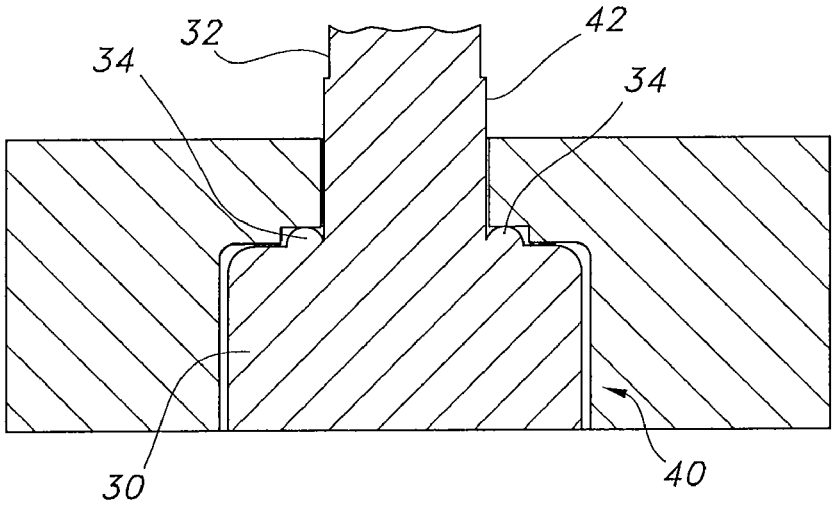
FIG. 5 is a cut-away view of part of the exemplary embodiment of the connector illustrated in FIG. 2 and illustrating an alternative placement of the third elastomer portion.

A third component of plug 30 may be a third elastomer portion 34 which may be an integral, or molded-in, seal which may have a third diameter 34*a* which may be larger than second diameter 42*a* and smaller than first diameter 40*a*, as best illustrated in FIG. 3. In an exemplary embodiment, the third elastomer portion 34 may be molded into and protrude from the upper surface 44 of the second end 40*c* of the first elastomer portion 40 along a top circumference of the first elastomer portion 40. In this embodiment, the third elastomer portion 34 may be positioned between side 40*h* of first elastomer portion 40 and second elastomer portion 42. In an alternative embodiment, illustrated in FIG. 5, third elastomer portion 34 may be positioned so that it touches against second elastomer portion 42. In all embodiments, third elastomer portion 34 may be integrally molded with first elastomer portion 40 to provide an integral seal as explained below.

Figure 6:
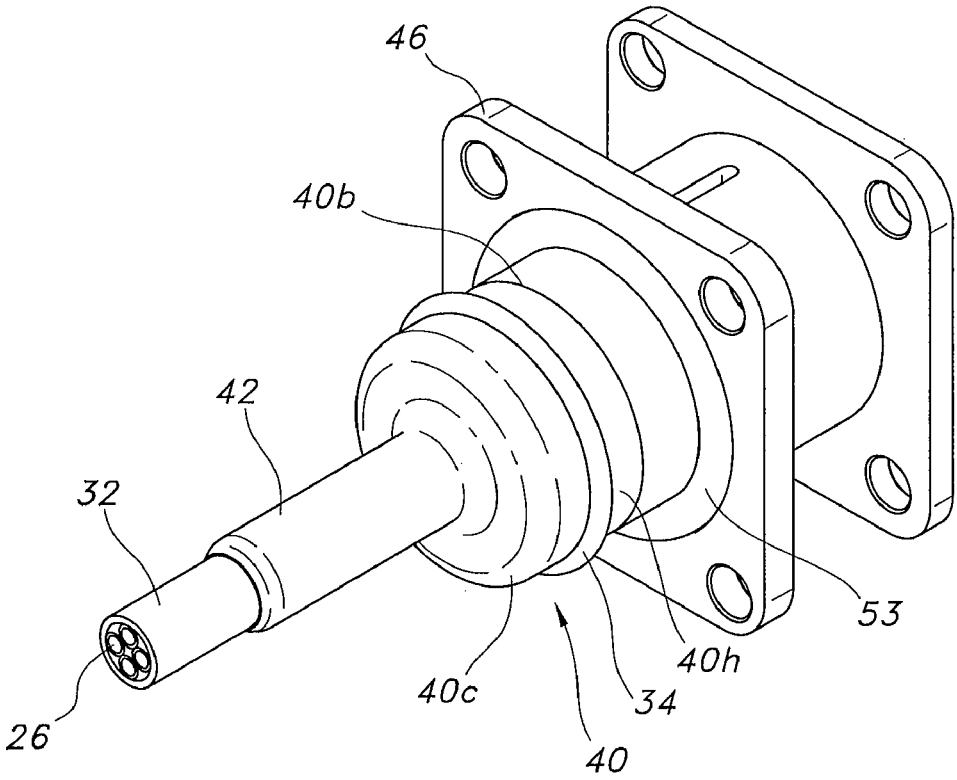
FIG. 6 is a perspective view of a connector in accordance with an alternative embodiment of the present invention.

In another alternative embodiment, illustrated in FIG. 6, the third elastomer portion 34 may be integrally molded with, and may protrude from, a circumference of side surface 40*h* of the first elastomer portion 40.

An exemplary embodiment of third elastomer portion 34, which may be used with any of the embodiments of the connector described herein, is shown in FIG. 3. It may be comprised of a circular O-ring profile ridge 35 protruding from the top surface 44 at the second end 40*c* of the first elastomer portion 40.

As shown in FIGS. 3 and 4, for example, the plug 30 may be used to form an apparatus that may provide a moisture resistant connection of at least one conductor within a jacket of elastomer material to at least a second conductor. The apparatus may comprise a connector described in any of the embodiments described herein along with an enclosure.

In an exemplary embodiment shown in FIGS. 3 and 4, the plug 30 may be disposed within an enclosure 48. The enclosure 48 may surround the plug 30 on three sides: side surface 40*h* of first elastomer portion 40; top surface 44 of first elastomer portion 40; and side surface 50 of second elastomer portion 42. The enclosure 48 may be adapted and configured to compress plug 30 against support 46 as discussed in more detail below. For example, the enclosure may be a pump housing.

As illustrated best in FIG. 3, the enclosure 48 may have a mating groove or recess 52 in the enclosure that may also be comprised of O-ring dimensions. The O-ring dimensions of O-ring profile ridge 35 may match the O-ring dimension of the mating groove or recess 52 so that O-ring ridge 35 may mate with the groove or recess 52 in the enclosure 48. It will be understood that the third elastomer portion 34 may form an integral seal that may be comprised of standard or non-standard components such as O-ring components or other components that perform in a manner similar to O-rings.

As shown, for example, in FIGS. 2 and 4, the first end 40*b* of the first elastomer portion 40 may sit snugly against support 46. This snug fit may be accomplished by making the respective shapes of the support 46 and the first elastomer portion 40 have corresponding shapes and sizes. Accordingly, the size and shape of surface 40*d* may correspond to the size and shape of surface 46*d;* the size and shape of surface 40*e* may correspond to the size and shape of surface 46*e*; and the size and shape of surface 40*f* may correspond to the size and shape of surface 46*f*. All of these respective corresponding surfaces may be bonded together with an adhesive. This bonding may provide a vertical surface bonding and two horizontal surface bondings, thereby providing bonding in two different directions. These bondings may resist breaking of the bonding between connector 30 and support 46 and may provide resistance to leakage between the support and the plug.

Flange 46*c* is part of support 46. As shown in FIGS. 2 and 4, a circumferential seal 53 may be disposed on top of flange 46*c*. A corresponding O-ring profile groove may be placed inside housing 48 that may form a seal between housing 48 and flange 46*c*. At least two bolts 54, 56 may be inserted through flange 46*c* into housing 48 in order to couple support 46 to enclosure 48. The O-ring seal 53 may be placed between bolts 54, 56 and junction point 47 at the junction of surfaces 46*g* and 46*i* of support 46 as shown in FIG. 4*a*.

The bolts 54, 56 may be tightened to pull enclosure 48 and support 46 toward each other thereby coupling enclosure 48 to support 46 and compressing the connector between and against enclosure 48 and support 46. As a result, enclosure 48 may abut the connector 30, the support 46 and the seal 53 and at least the first elastomer portion 40, the third elastomer portion 34, and the O-ring seal 53 may be placed under compression between the enclosure 48 and the support 46 creating a dead space 58 that may be moisture free and fluid free.

The creation of dead space 58 may avoid the necessity of using a bonding material to bond the sides of plug 30 to the sides of enclosure 48. Nevertheless, a bonding material may also be used if desired to further reduce the possibility of moisture accumulation.

In addition, as shown, for example in FIG. 4, part 42*b* of the second elastomer portion 42 may extend beyond the confines of enclosure 48 through opening 48*a* of the enclosure. The second elastomer portion 42 may be bonded to the jacket 32 in order to provide additional resistance to the incursion of moisture into the plug and into space 90. Extending the second elastomer portion beyond the confines of the enclosure and bonding the second elastomer portion to the jacket may minimize moisture build up or minimize the presence of contaminants from accumulating between enclosure 48 and the plug and within the dead space 58.

Compression devices other than bolts may be used as long as the compression devices are able to compress support 46 and enclosure 48 together. Such alternative compression devices may, for example, be placed inside of enclosure 48 and extend from enclosure 48 into support 46.

In all embodiments, each of the components 30, 32, 34, 42 may be made of the same elastomer material or different elastomer materials. The elastic properties of the elastomers may allow the plug 30 to expand and contract with temperature fluctuations, keeping the plug sealed against the support 46 and against the elastomer jacket 32 without delaminating and leaking.

As shown, for example, in FIG. 4, connector pins 60 and 62 may be disposed inside of, and may extend from, space 90 into space 70 of support 46. Also as illustrated in FIG. 4, exemplary conductors such as wires 26*a* and 26*b* from within jacket 32 may extend from elastomer jacket 32 through inner surface 41 of first elastomer portion 40, and into space 90 where they may be respectively attached to connector pins 60 and 62.

Although the embodiment illustrated in FIG. 4 shows only two connector pins, it will be understood that more or fewer connector pins may be disposed inside space 90. Also, although the embodiment illustrated in FIG. 4 shows only two wires 26*a* and 26*b*, it will be understood that conductors other than wires may extend into space 90, that more than two conductors or wires may extend into space 90, and that each of the plurality of conductors or wires inside space 90 may be connected to its own respective connector pin.

Figure 7:
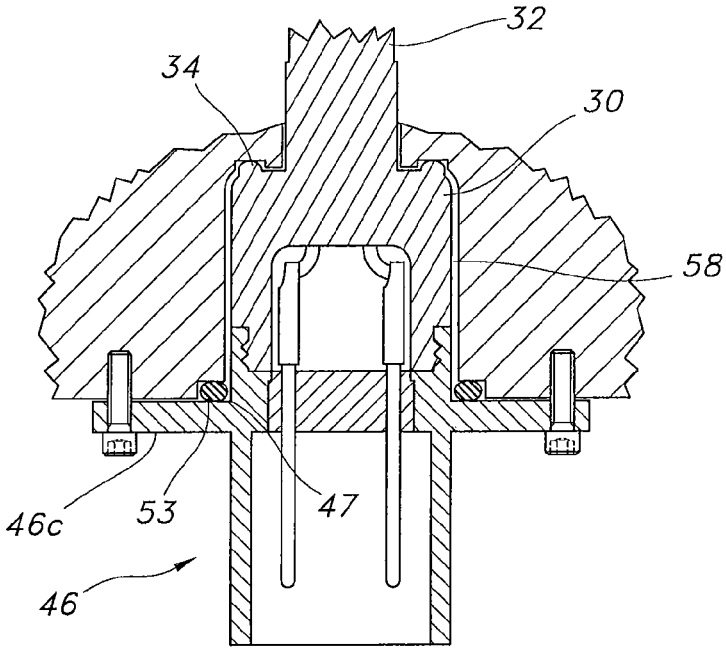
FIG. 7 is a cross-section view of an alternative apparatus for providing a moisture resistant connection using the exemplary connector illustrated in FIGS. 2 and 3.

In an alternative embodiment, shown in FIG. 7, O-ring seal 53 may be placed at junction point 47. This placement of O-ring seal 53 may also be used to create a dead space 58. In another alternative embodiment, shown in FIG. 9, O-ring seal 53 may be placed inside flange 46*c* with a portion of the O-ring seal 53 extending above the top surface of flange 46*c*. When enclosure 48 is pulled toward flange 46*c*, the O-ring seal 53 may be placed under compression, along with all of the other elements discussed in connection with the other embodiments herein, creating a dead space 58 that may be moisture free and fluid free.

Figure 8:
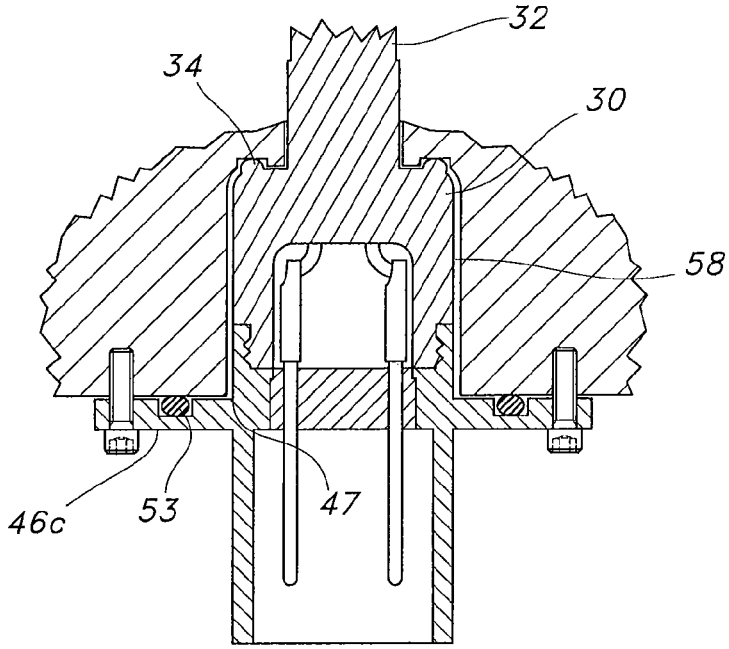
FIG. 8 is a cross-section view of another alternative apparatus for providing a moisture resistant connection using the exemplary connector illustrated in FIGS. 2 and 3.

In another alternative embodiment shown in FIG. 8, O-ring 53 may be inserted into, and protrude from, flange 46*c* of support 46. In this embodiment, a seal may be formed when enclosure 48 is compressed against support 46.

Figure 9:
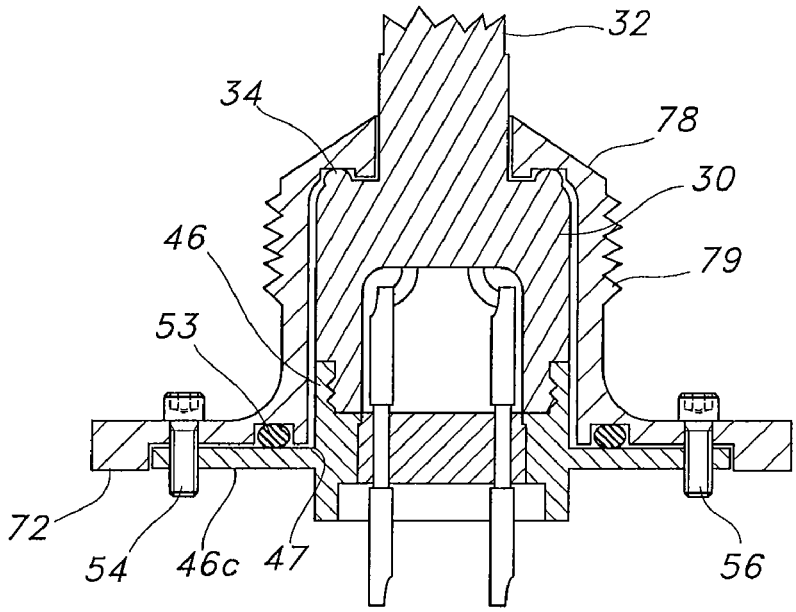
FIG. 9 is a cross-section view of another alternative apparatus for providing a moisture resistant connection using the exemplary connector illustrated in FIGS. 2 and 3.
Figure 10:
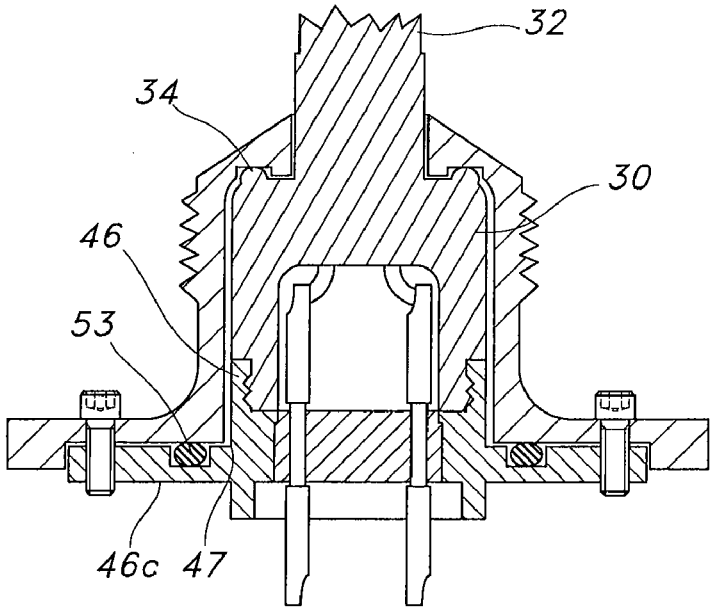
FIG. 10 a cross-section view of yet another alternative apparatus for providing a moisture resistant connection using the exemplary connector illustrated in FIGS. 2 and 3.

Alternative embodiments of the apparatus are shown in FIGS. 9 and 10, which are cross-section views using the exemplary connector illustrated in FIGS. 2 and 3. In these embodiments, an enclosure comprising a cover 78 having threads 79 may be located over and around plug 30. Cover 78 may have a flange-type extremity 72 which may be bolted to support 46 with bolts 54, 56. In these embodiments, O-ring seal 53 may be placed away from the juncture 47. As illustrated, O-ring seal 53 may be placed either on top of flange 46*c* as shown in FIG. 9 or within and protruding from flange 46*c* as shown in FIG. 10. In an alternative embodiment to FIGS. 9 and 10, O-ring seal 53 may be placed at junction 47.

Figure 11:
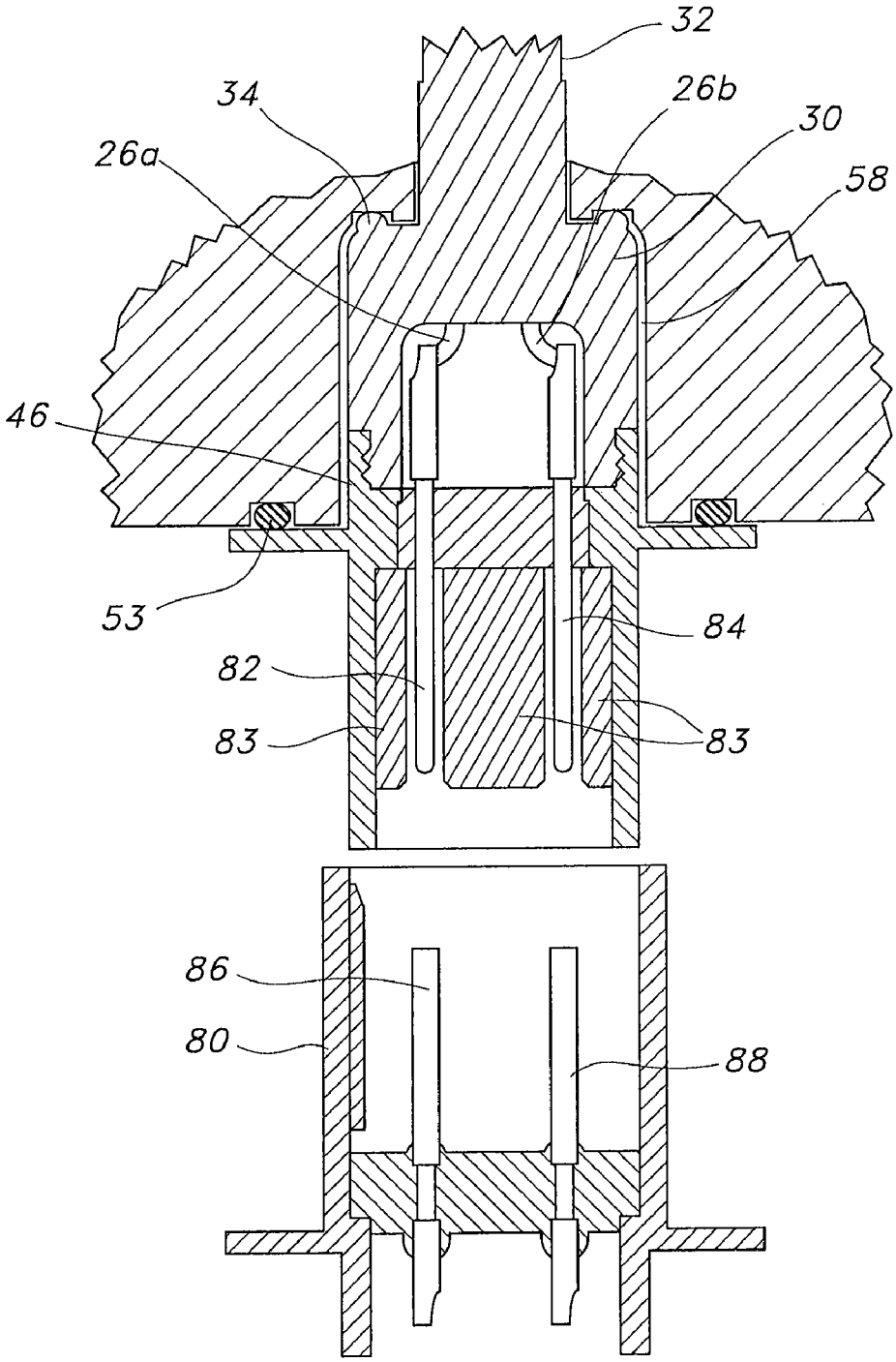
FIG. 11 is a cross-section view of an apparatus using the exemplary connector illustrated in FIGS. 2 and 3 with safety features.

FIG. 11 is a cross-section view of an apparatus using the exemplary connector illustrated in FIGS. 2 and 3 with safety features. FIG. 11 illustrates how a connector of the present invention may be coupled to a cartridge 80. As shown in FIG. 11, plug pins 82, 84 may be placed on the housing side (the supplied power side), and socket pins 86, 88 may be placed on the cartridge side. When plug pins 82, 84 are disposed on the supplied power side, the electrical load side may include socket pins 86, 88 attached to cartridge 80 so that power may be transferred from the plug pins 82, 84 to the socket pins 84, 86 when the connector is coupled to the cartridge.

As shown in FIG. 11, PEEK (Polyetheretheketone) inserts 83 may surround and extend beyond the ends of the plug pins 82, 84 as a safety feature. The inserts 83 may protect equipment and/or personnel from hazardous voltages if electrical power is present when the connector is mated to or unmated from socket pins 86, 88 in the cartridge 80 or otherwise not connected to the socket pins. Inserts 83 may be bonded to one or more surfaces of support 46.

All of the embodiments illustrated herein may have supply side plug pins as illustrated in FIG. 11 and may use PEEK inserts 83 as safety features around the supply side plug pins. All of the embodiments may also be connectable to a cartridge that may have load side plug pins. It will be understood, in addition, that any one of the embodiments may use load side pins in the connector and supply side pins in the cartridge.

In all of the embodiments illustrated herein, wires or other conductors may extend from elastomer jacket 32 in the same way explained regarding FIG. 4 and may be connected to the conductors (connector pins, connector socket pins, solder cup pins) that may be disposed in space 90. In any of the embodiments, depending on the connector pin configuration, the length and number of conductors inside space 90 may be changed and the accompanying connector components may be changed in shape and dimension to suit. It will be understood that the various connector configurations illustratively shown as being inside space 90, may be used along with, or interchanged, with other connector configurations and with configurations of other connector components.

Although the invention is illustrated and described herein with reference to specific embodiments, the invention is not intended to be limited to the details shown. Rather, various modifications may be made in the details within the scope and range of equivalents of the claims and without departing from the invention.

What is claimed:

1. An elastomer moisture resistant connector for at least one conductor disposed at least partially within a jacket of elastomer material, the connector comprising:

a first elastomer portion having a first end and a second end, the first end adapted to be compressed against a support;

a second elastomer portion, integrally molded with the first elastomer portion and extending from the second end of the first elastomer portion, and configured to enclose at least a portion of the jacket; and a third elastomer portion, integrally molded with the first elastomer portion and protruding from the second end of the first elastomer portion, and adapted to be compressed by an enclosure, wherein the third elastomer portion forms a shoulder between the first elastomer portion and the second elastomer portion against which the enclosure is mounted, wherein the third elastomer portion is configured to fit into a groove in the enclosure.

2. The connector of claim 1, wherein the third elastomer portion protrudes along a circumference of the first elastomer portion.

3. The connector of claim 1, wherein the third elastomer portion protrudes along a circumference on a top surface of the first elastomer portion.

4. The connector of claim 1, wherein a diameter of the third elastomer portion is greater than a diameter of the second elastomer portion.

5. The connector of claim 1, wherein a diameter of the first elastomer portion is greater than a diameter of the third elastomer portion.

6. The connector of claim 1, wherein the third elastomer portion protrudes along a side circumference of the first elastomer portion.

7. The connector of claim 6, wherein a diameter of the third elastomer portion is greater than a diameter of the second elastomer portion.

8. The connector of claim 1, wherein a portion of the at least one conductor extends into a space located between inside surfaces of the first elastomer portion.

9. The connector of claim 1, wherein the elastomer material comprising the jacket is a different elastomer material comprising the connector.

10. An apparatus for providing a moisture resistant connection of at least one conductor within a jacket of elastomer material to at least a second conductor, the apparatus comprising:

a connector having a first elastomer portion having a first end and a second end;

a second elastomer portion, integrally molded with the first elastomer portion and extending from the second end of the first elastomer portion, at least a portion of the jacket being disposed within the second elastomer portion; and a third elastomer portion, integrally molded with the first elastomer portion and protruding from the second end of the first elastomer portion;

an enclosure configured to compress the connector against a support, and a seal disposed between the enclosure and the support, wherein the third elastomer portion forms a shoulder between the first elastomer portion and the second elastomer portion against which the enclosure is mounted.

11. The apparatus of claim 10, further comprising a coupler for compressing the connector and the seal between the enclosure and the support.

12. The apparatus of claim 11, wherein the coupler couples the enclosure to the support.

13. The apparatus of claim 10, wherein the enclosure abuts the connector, the support, and the seal.

14. The apparatus of claim 10, wherein part of the second elastomer portion extends beyond the enclosure.

15. The apparatus of claim 10, further comprising a space located between the third elastomer portion, the first elastomer portion, and enclosure, and the seal.

16. The apparatus of claim 10, wherein the second elastomer portion is bonded or fused to the jacket.

17. The apparatus of claim 10, wherein the first elastomer portion is bonded to the support.

18. The apparatus of claim 17, wherein the first elastomer portion is bonded to a first surface of the support and to a second surface of the support.

19. An apparatus for providing a moisture resistant connection of at least one conductor within a jacket of elastomer material to at least a second conductor, the apparatus comprising:

a connector having a first elastomer portion having a first end and a second end;

a second elastomer portion, integrally molded with the first elastomer portion and extending from the second end of the first elastomer portion, at least a portion of the jacket being disposed within the second elastomer portion; and a third elastomer portion, integrally molded with the first elastomer portion and protruding from the second end of the first elastomer portion; and an enclosure configured to compress the connector against a support, wherein the third elastomer portion forms a shoulder between the first elastomer portion and the second elastomer portion against which the enclosure is mounted, wherein the first elastomer portion is bonded to the support, wherein the first elastomer portion is bonded to a first surface of the support and to a second surface of the support.

* * * * *